US005624715A

United States Patent [19]

Gueggi et al.

[11] Patent Number: 5,624,715

[45] Date of Patent: Apr. 29, 1997

[54] METHOD AND APPARATUS FOR CURTAIN COATING A MOVING SUPPORT

[75] Inventors: Markus Gueggi, Marly; Maurice Pasquier, La Tour-de-Trême; Peter Schweizer, Wünnewil, all of Switzerland

[73] Assignee: Ilford AG, Freiburg, Switzerland

[21] Appl. No.: 534,842

[22] Filed: Sep. 27, 1995

[30] Foreign Application Priority Data

Sep. 27, 1994 [EP] European Pat. Off. ..... 94810560

[51] Int. Cl.[6] ..... B05D 1/30; B05C 5/00

[52] U.S. Cl. ..... 427/420; 427/294; 118/324; 118/DIG. 4

[58] Field of Search ..... 427/420, 294; 118/324, DIG. 4

[56] References Cited

U.S. PATENT DOCUMENTS

| | | | |
|---|---|---|---|
| 3,508,947 | 4/1970 | Hughes . | |
| 3,632,374 | 1/1972 | Greiller | 427/420 |
| 3,867,901 | 2/1975 | Greiller . | |
| 4,128,667 | 12/1978 | Timson . | |
| 4,842,900 | 6/1989 | Miyamoto . | |
| 5,206,057 | 4/1993 | Finnicum et al. | 427/420 |
| 5,224,996 | 7/1993 | Ghys et al. | 118/DIG. 4 |

FOREIGN PATENT DOCUMENTS

| | | |
|---|---|---|
| A0489978 | 6/1992 | European Pat. Off. . |
| A0551237 | 7/1993 | European Pat. Off. . |
| A1928025 | 12/1969 | Germany . |
| A2723444 | 12/1977 | Germany . |
| A1559701 | 1/1980 | United Kingdom . |
| WOA9202851 | 2/1992 | WIPO . |

*Primary Examiner*—Katherine A. Bareford
*Attorney, Agent, or Firm*—Richard Linn

[57] ABSTRACT

A method for curtain coating a moving support with a liquid coating material. An evacuating device is utilized to evacuate air carried along with the moving support. A device for carrying out the method includes a pourer having a pourer lip, a pouring roll carrying a support, and an evacuating device which is disposed in front of the curtain. The evacuating device includes an evacuating blade having a front edge facing the curtain. The front edge is provided with a slot which is connected to a vacuum installation. The method and device allow a substantial stabilization of the curtain at its point of contact with the support.

25 Claims, 2 Drawing Sheets

METHOD AND APPARATUS FOR CURTAIN COATING A MOVING SUPPORT

BACKGROUND OF THE INVENTION

The present invention refers to a method and apparatus for curtain coating a moving support with a liquid coating material. Especially in wide machines and at high speeds, curtain coating involves a great number of problems with respect to the stabilization of the liquid curtain and an even application thereof to the support. One of these problems is the fact that the freely falling liquid film is forwardly deformed, i.e. in the direction of the moving support. This divergence from the perpendicular falling direction is caused by the boundary layer of air which is carried along by the support.

Different methods and apparatus for the stabilization of the liquid curtain in this respect are known. Thus, amongst others, a coating installation is known from EP-A-0 489 978 which comprises an air shield which, seen in the direction of the moving support, is disposed in front of the liquid film and is provided with an opening from which the air stemmed in said shield is evacuated. Due to the use of a shield, the distance between the point where the air is evacuated and the curtain is quite large, whereby the efficiency of the device is reduced. Furthermore, a method and device for curtain coating is known from EP-A-0,551,237, wherein a stabilization of the air in front of the curtain is attempted by measuring the air pressure in the space in front of the pouring curtain in order to supply or remove air on the basis of a reference value. However, a precise control requires a complicated apparatus in order to maintain a uniform air pressure across the entire width of the machine.

SUMMARY OF THE INVENTION

In view of the background of this prior art, it is the object of the present invention to provide a method and apparatus for curtain coating which strongly reduce the influence of the air carried along by the moving support. This object is attained by a method wherein the air carried along by the moving support is evacuated, when seen in the moving direction of the support, in front of the curtain, at the dynamic wetting line of the curtain, and near the support directly on the pouring roll by means of an evacuating device, the mouth of the evacuating opening being disposed at the front edge of the evacuating device. In a further development of the method, the pouring curtain is additionally stabilized by a controlled supply and a subsequent evacuation of air in the space in front of the pouring curtain.

BRIEF DESCRIPTION OF THE DRAWING

The invention is explained in more detail herein-after with reference to a drawing of an embodiment.

DETAILED DESCRIPTION OF THE INVENTION

Figure 1:
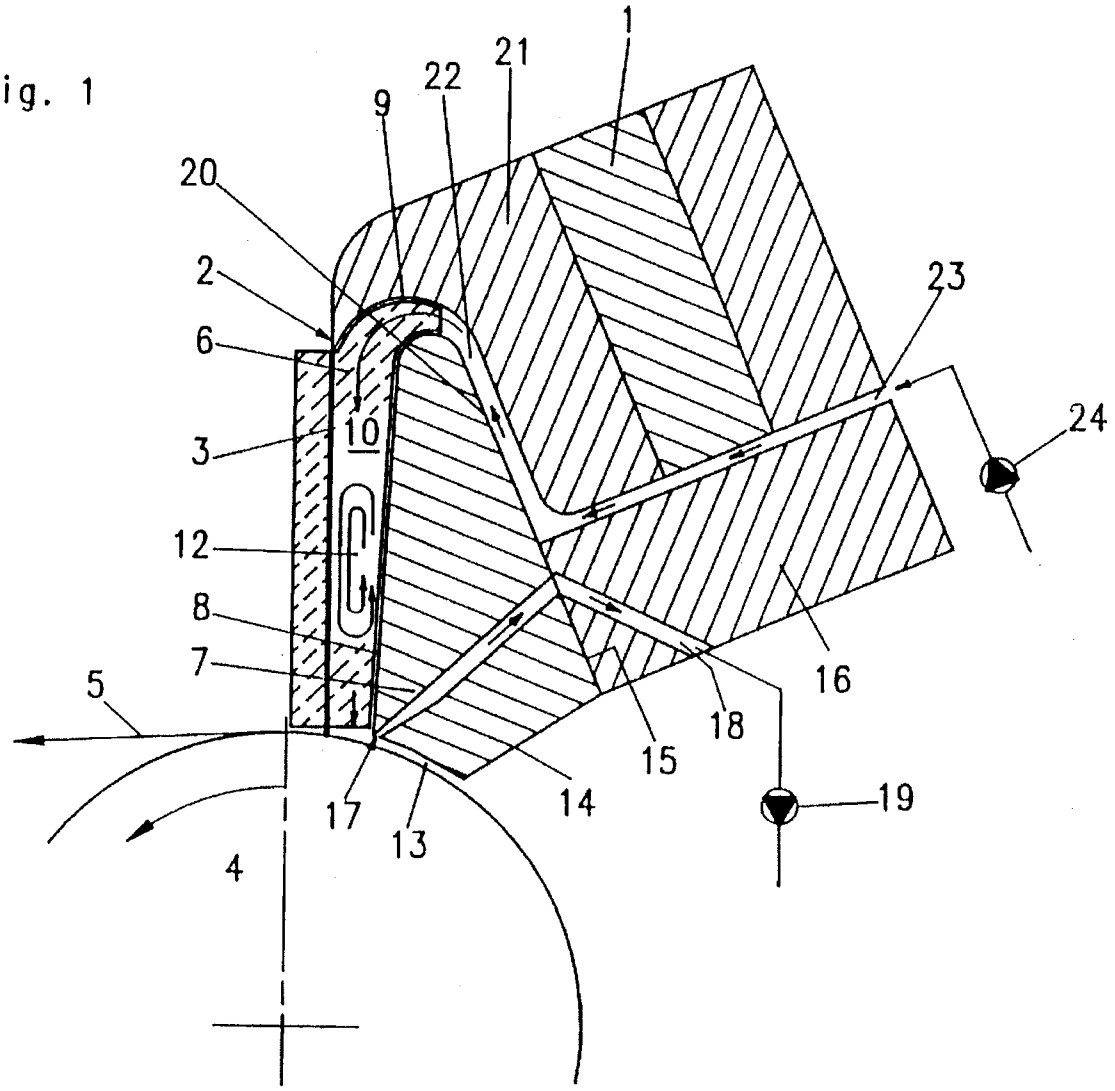
FIG. 1 schematically shows a cross-section of a curtain coating installation.
Figure 2:
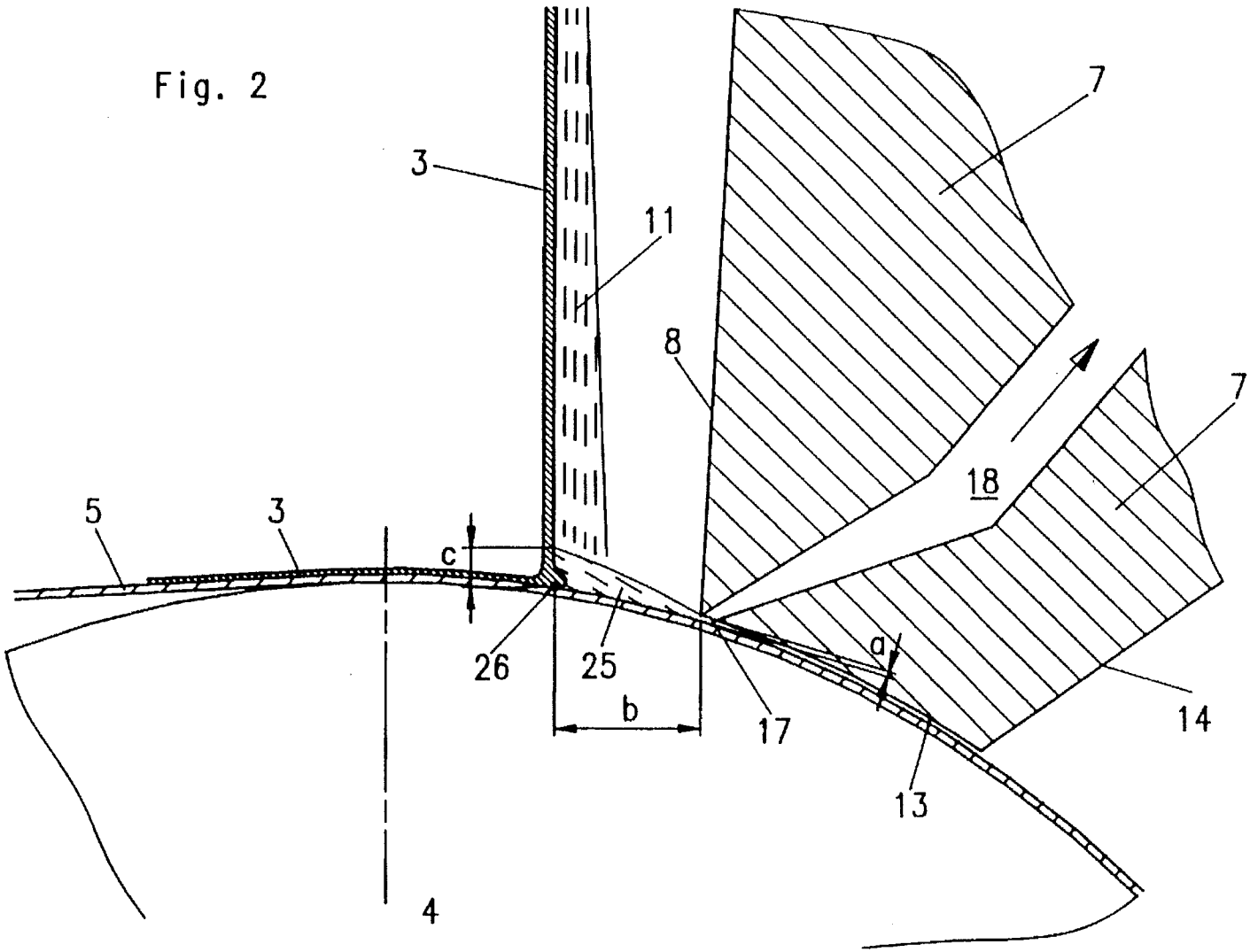
FIG. 2 shows an enlarged detail of FIG. 1.

FIG. 1 shows a cross-section of the inventively essential section of a coating installation, comprising a schematically represented pourer 1 which is terminated by a pouring lip 2 from where the liquid film 3, hereinafter called curtain, freely falls towards pouring roll 4 on which support 5 is schematically shown and moves fin the direction of the arrow, see also FIG. 2. The curtain is limited on both sides by lateral guides 6.

In front of the curtain, at a distance b (see FIG. 2), a blade 7 is disposed whose front side 8 facing the curtain is not parallel to the curtain in this example but disposed at a greater distance therefrom at the top than near the roll. With a machine width of about 1.5 m, high flexural strengths of the pouring roll and of the blade are required. Accordingly, the blade must be designed as a beam having a sufficient height and thus a high geometrical moment of inertia. As follows from FIGS. 1 or 2, surface 13 of the blade, facing the pouring roll, is approximately parallel to the surface of the pouring roll resp. of the support, lower portion 14 being approximately perpendicular to the pouring roll surface. Rear surface 15 of the blade is parallel to the front side of base 16 resp. to the individual pouring plates of pourer 1.

The air carried along with the support, represented as a boundary layer 25 (see FIG. 2), is completely stemmed by the liquid film of the curtain in the area of dynamic wetting line 26. This process may be the cause of perturbations, e.g. deformations of the curtain which lead to a reduced coating quality. By means of the blade, a major proportion of the air which is carried along is kept away from dynamic wetting line 26, while it is possible to further reduce said perturbations according to the following factors:

a) a small distance a between the blade and the support; as well as b) a small distance b between the blade and the dynamic wetting line of the curtain.

The size c of the boundary layer 25 striking the curtain is thus minimized. Yet, even if the distance a between the blade and the support (FIG. 2) is kept very small, e.g. 0.1 to 1.0 mm, preferably 0.1 to 0.5 mm, and the distance b between the blade and the dynamic wetting line is adjusted to be 5 to 30 mm, preferably 10 to 20 mm, the entry of a residual quantity of air and the formation of a new boundary layer cannot be prevented entirely.

For a substantially complete prevention of the entry of a residual quantity of air, a slot 17 is provided on the entire length of the blade, the opening of said slot being disposed immediately behind the front edge of the blade. Slot 17 is connected to a ventilator 19 by a channel 18 in order to evacuate said residual quantity of air at the front edge of the blade. This measure provides a substantial stabilization of the curtain when it strikes the moving support, whereby an elimination or a strong reduction of the curtain deformation prevailing at this point is obtained.

The area in front of the curtain is limited at the top by underside 9 of pouring lip 2, at the bottom by support 5, opposite the curtain by front side 8 of the blade, and laterally by lateral guides 6, and thus constitutes a substantially closed space 10. Without special measures, the boundary layer of air 11 along the falling curtain (FIG. 2) would produce rotating air turbulences which may divide into individual unstable cells. The flow of the curtain is thereby disturbed and unsteady, which results in a reduced coating quality.

In order to prevent the formation of turbulences 12, an opening 22 is provided which extends between the rear upper edge 20 of the blade and the foremost pouring plate 27 across the entire width of the machine, said opening communicating with a second channel 23 and a second ventilator 24. Air supply opening 22 ends at the underside 9 of pouring lip 2, in such a manner that the air supplied to this point at a small speed is downwardly deflected and finally evacuated by the slot 17 of the blade.

Different measures allow to provide a very uniform flow, while the supplied air is preferably preheated. With an adequate adjustment of the supplied and the evacuated air quantities, the contact line of the curtain on the support, i.e. the dynamic wetting line 26, can be placed at the desired point. Since the evacuating blade, as explained above, provides a stabilization of the dynamic wetting line, a uniform coating is obtained by a combination of the described measures. The devices for air evacuation and supply may be combined and controlled as a single unit.

We claim:

1. A method for curtain coating a moving support with a liquid coating material, comprising the steps of:

moving a support to be coated with the liquid coating material along a pouring roll, said support having a layer of air carried therealong;

pouring said liquid coating material from a pourer onto said support along a dynamic wetting line formed on said support;

evacuating said flow of air and at least a portion of said layer of air that is carried along with said support with an evacuation device; and controllably supplying a substantially constant flow of air in a space upstream of said curtain, said flow of air being supplied through an opening defined by respective opposing surfaces of said evacuation device and said pourer.

2. The method of claim 1, wherein the air carried along by the moving support is evacuated with an evacuating slot that is in communication with a ventilator device.

3. The method of claim 2, wherein said slot has a mouth that is disposed proximate the surface of the support and proximate the dynamic wetting line of the curtain.

4. The method of claim 3, wherein the mouth of said slot is disposed a distance from the support which is between 0.1 mm and 0.1 mm.

5. The method of claim 4, wherein the distance of the mouth from the support is between 0.1 mm and 0.5 mm.

6. The method of claim 3, wherein the mouth of said slot is disposed a distance from the dynamic wetting line which is between 5 mm and 30 mm.

7. The method of claim 6, wherein the distance of the mouth from the dynamic wetting line is between 10 mm and 20 mm.

8. The method of claim 2, wherein the supplied flow of air and the air carried along by the moving support is evacuated across the entire width of the support.

9. The method of claim 1, wherein the supplied flow of air is preheated.

10. The method of claim 1, wherein the supplied flow of air is controlled to adjust the location of the dynamic wetting line of the curtain on the support.

11. The method of claim 1, wherein said opening is formed by a gap between the rear surface of said evacuation device facing away from said curtain and a front side of said pourer facing said curtain, whereby said opening provides a constant supply of air for evacuation through the evacuation device for preventing the formulation of turbulence in said curtain.

12. A device for curtain coating a moving support with a liquid coating material, comprising:

a pouring roll for carrying the moving support in a first direction, said moving support having a layer of air carried therealong;

a pourer comprised of a pouring lip disposed above said pouring roll, wherein the liquid coating material is poured from said pourer as a curtain onto said moving support; and an evacuating blade disposed upstream of said curtain relative to said first direction, said evacuating blade having a front surface disposed substantially parallel to and facing said curtain, a rear surface facing away from said curtain, and a slot connected to a vacuum installation, said slot having a mouth disposed proximate to a surface of the moving support upstream of said curtain, whereby at least a portion of said layer of air is evacuated by said slot from above said moving support prior to reaching said curtain;

wherein an opening is formed above said slot between the rear surface of the evacuating blade and a front side of said pourer facing said curtain, and means for supplying a flow of air through said opening into a space upstream of said curtain for evacuation through said slot for preventing the formulation of turbulence in said curtain.

13. The device according to claim 12, wherein said opening communicates with a channel formed between said pourer and said evacuating blade, said channel receiving air which flows through said opening and along said curtain and which is evacuated through said slot, whereby air is constantly supplied and evacuated in a controlled manner in said space upstream of the curtain relative to said first direction.

14. The device according to claim 12, wherein said curtain is applied to said support at a dynamic wetting line, a location of said dynamic wetting line being controlled by the flow of air from said opening to said slot.

15. A device for coating a moving support with a liquid coating material, comprising:

a pouring roll for carrying the moving support, said moving support having a layer of air carried therealong;

a pourer having a pouring lip disposed above said pouring roll, wherein the liquid coating material is poured from said pourer as a curtain onto said moving support; and means for controllably maintaining a constant flow of air in a space upstream of said curtain, said means including a means for supplying a positive flow of air into said space upstream of said curtain and an evacuation means having a mouth disposed proximate to a surface the moving support upstream of said curtain for removing said flow of air and at least a portion of said layer of air that is carried along with said support;

said means for supplying positive flow of air comprising an opening disposed above said mouth of said evacuation means and a means for supplying a positive flow of air through said opening.

16. A device according to claim 15, wherein said evacuation means includes an evacuating blade disposed upstream of said curtain, said evacuating blade having a slot connected to a vacuum installation, said mouth communicating with said slot for evacuating air from above said moving support.

17. A device according to claim 16, wherein said opening is formed between a rear surface of the evacuating blade facing away from said curtain and a front side of the pourer facing said curtain, said opening communicating with a channel formed between said pourer and said evacuating blade, wherein said channel receives air which flows through said opening and along said curtain and which is evacuated through said slot.

18. The device according to claim 17, wherein said curtain is applied to said support at a dynamic wetting line, a location of said dynamic wetting line being controlled by said constant flow of air.

19. The device according to claim 18, wherein said slot has a mouth that is disposed proximate to the surface of the support ant to the dynamic wetting line of the curtain.

20. The device according to claim 19, wherein the mouth of said slot is disposed a distance from the support which is between 0.1 mm and 0.1 mm.

21. The device according to claim 20, wherein the distance of the mouth from the support is between 0.1 mm and 0.5 mm.

22. The device according to claim 19, wherein the mouth of said slot is disposed a distance from the dynamic wetting line which is between 5 mm and 30 mm.

23. The device according to claim 22, wherein the distance of the mouth from the dynamic wetting line is between 10 mm and 20 mm.

24. The device according to claim 15, wherein said evacuation means comprises means for evacuating the supplied flow of air and the air carried along by the moving support across the entire width of the support.

25. The device according to claim 15, further comprising means for preheating the flow of air.

* * * * *